US008876175B2

(12) United States Patent
Lopes

(10) Patent No.: US 8,876,175 B2
(45) Date of Patent: Nov. 4, 2014

(54) DOOR HANDLE TYPE CLOSURE SYSTEM

(75) Inventor: Antônio Jorge Freire Lopes, São Paaulo (BR)

(73) Assignee: Unikey Componentes Industriais Ltda., Cotia/SP (BR)

( * ) Notice: Subject to any disclaimer, the term of this patent is extended or adjusted under 35 U.S.C. 154(b) by 43 days.

(21) Appl. No.: 13/282,556

(22) Filed: Oct. 27, 2011

(65) Prior Publication Data

US 2012/0104772 A1 May 3, 2012

(30) Foreign Application Priority Data

Oct. 28, 2010 (BR) ..... 9001959 U

(51) Int. Cl.
*E05C 3/04* (2006.01)
*E05B 15/00* (2006.01)
*E05B 15/16* (2006.01)

(52) U.S. Cl.
CPC ..... *E05C 3/042* (2013.01); *E05B 15/0053* (2013.01); *E05B 2015/1678* (2013.01)
USPC ..... 292/202

(58) Field of Classification Search
CPC ..... E05B 63/0056; E05B 85/26; E05C 3/042
USPC ..... 292/1, 194, 195, 202, 336.3, DIG. 20, 292/DIG. 38, DIG. 47
See application file for complete search history.

(56) References Cited

U.S. PATENT DOCUMENTS

| | | | | |
|---|---|---|---|---|
| 2,648,967 | A * | 8/1953 | Holmsten | 70/89 |
| 4,736,972 | A * | 4/1988 | Mosch | 292/204 |
| 4,801,164 | A * | 1/1989 | Mosch | 292/204 |
| 5,219,193 | A * | 6/1993 | Piltingsrud | 292/240 |
| 6,068,306 | A * | 5/2000 | Brautigam | 292/242 |
| 7,665,775 | B1 * | 2/2010 | Miller et al. | 292/240 |
| 2009/0267360 | A1 * | 10/2009 | Anderson et al. | 292/202 |

* cited by examiner

*Primary Examiner* — Kristina Fulton
*Assistant Examiner* — Nathan Cumar
(74) *Attorney, Agent, or Firm* — William J. Sapone; Ware Fressola Maguire & Barber LLP

(57) ABSTRACT

A door handle closure system has a positioning washer that holds a door handle in an "open" or "closed" position. The positioning washer is made of a resilient thermoplastic material, providing a positive spring feeling when the door handle reaches the opened or closed positions. The door handle (1) has a longitudinal rib (1.2) received in a cut (2.3) provided in the washer (2). In the open position, the washer (2) has external upsets which are received within two entrances (3.2) located in the fixed bushing (3). In any intermediate position, the external upsets (2.1) are dislocated from the entrances (3.2) of the fixed bushing (3), deforming part of the washer (2), so as to reduce its original diameter, in effect, loading the "spring". In the closed position, the external upsets (2.1) are received within two entrances (3.2) located opposite thereto in the fixed bushing (3), relieving the spring pressure.

2 Claims, 6 Drawing Sheets

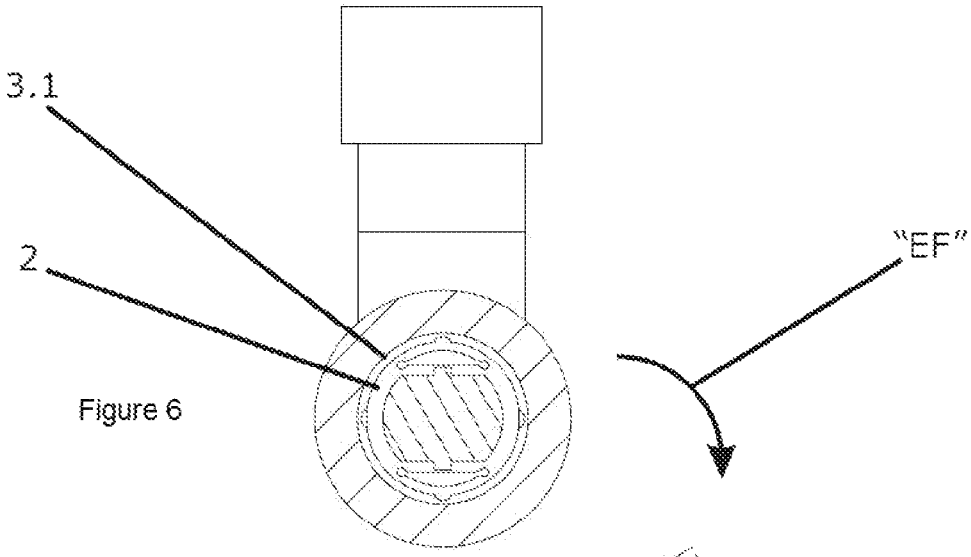
Figure 6
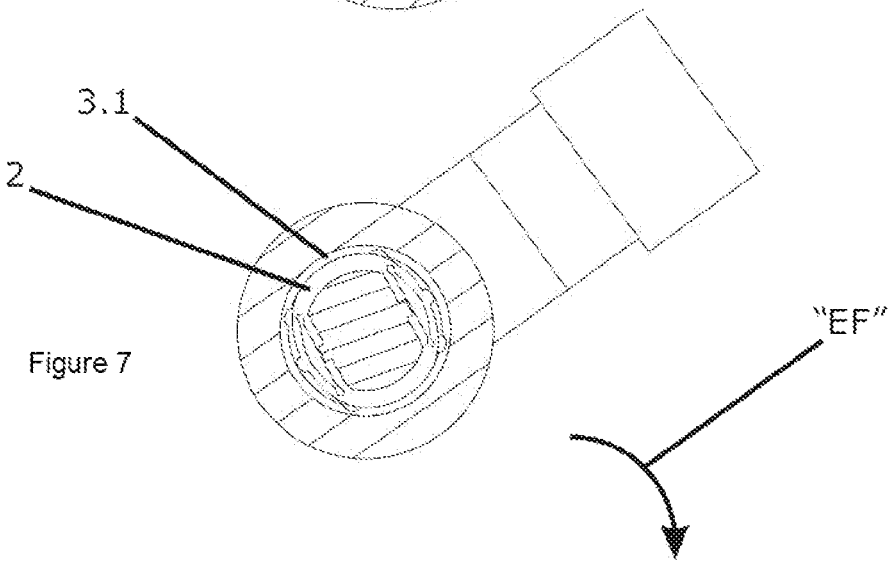
Figure 7
Figure 8
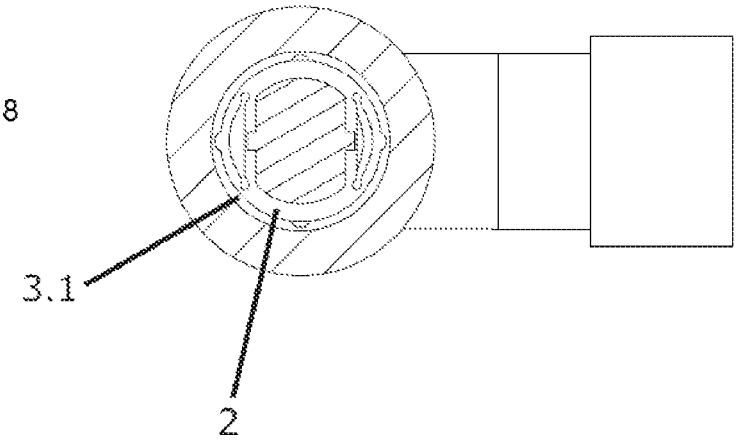

DOOR HANDLE TYPE CLOSURE SYSTEM

TECHNICAL FIELD

This invention relates to a novel door handle type closure system, particularly as applied to doors of electrical panels in general.

The door handle type closure system described herein is distinguishable from other similar closure systems because it comprises an exclusive "positioning washer" that helps to keep the position of the door handle when in "open" or "closed" position, as well as transferring a sensation for indicating that the door handle reached the proper limit.

BACKGROUND ART

Door handle type closure systems are common and widely used in doors of electrical panels in general, and the like. In general, such systems provide a movable door handle, a fixed bushing and a movable latch tied to the movable door handle. These three basic elements are coupled to each other so that the closing and/or opening of a door (or a set of doors) are allowed. Typically, this closure system is used in doors of electrical panels, and a single action on the door handle can result in opening or closing the door by rotating, resulting in displacement of the movable latch.

Conventionally, it is noted that when the door handle is in a "vertical" position, it is referred to as being in an "open" position, and when the door handle is in a "horizontal" position, it is referred as being in a "closed" position. The difference between these positions is approximately ninety degrees Cartesian.

Although this type of closure is common and practical (since the opening and closing of doors depend only on a simple movement of the door handle), it is impossible not to notice its strong negative aspect.

This strong negative aspect is related to the clearances among the three basic components that make up the closure system. These clearances can generate a "misalignment" of the door handle when it is in the "closed" position (horizontal). Said "misalignment" (which is partly due to the strong gravitational force) detract from the visual aesthetics of the product, since a uniform alignment of the door handle is not kept.

Based on this scenario, the present invention was developed.

SUMMARY OF THE INVENTION

Aiming to eliminate the aforementioned strong negative aspect belonging to the state-of-the-art door handle type closure systems, this invention was developed, disclosing a novel door handle type closure system.

In addition to the door handle, the fixed bushing and the movable latch, the door handle type closure system disclosed herein comprises an exclusive "positioning washer" that serves as a lateral spring in relation to the inner wall of the fixed bushing. This "positioning washer" is made of a thermoplastic material and has the characteristic of resilience to provide a spring effect, and thus it is able to provide a positive feel at the "limit" of the door handle, that is, when the latch reaches the open and the closed positions.

The "limit", which is resultant of the physical construction of the positioning washer and the fixed bushing, eliminates the gravity effect on the clearances among the components of the closure system disclosed herein, and, consequently, the position of the door handle is maintained, since the possibility of "misalignment" is eliminated.

BRIEF DESCRIPTION OF THE FIGURES

The present invention will be described in detail based on the figures listed below, wherein;

FIG. 6 illustrates a schematic cut view of the closure system in the "open" position;

FIG. 7 illustrates a schematic cut view of the closure system in an "intermediate" position, and;

FIG. 8 illustrates a schematic cut view of the closure system in the "closed" position.

DETAILED DESCRIPTION OF THE INVENTION

Figure 1:
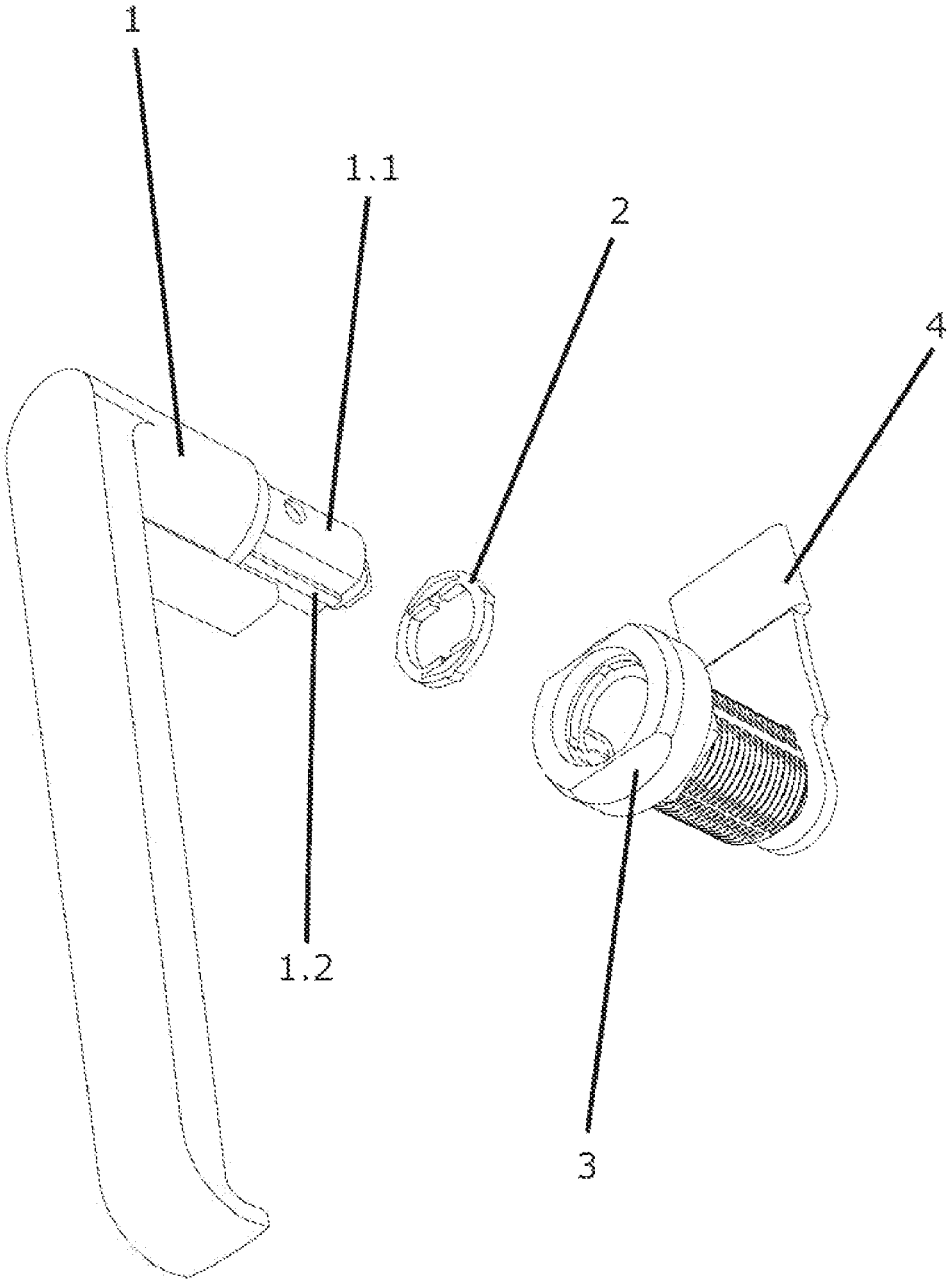
FIG. 1 is a perspective exploded view illustration of the door handle type closure system.
Figure 2:
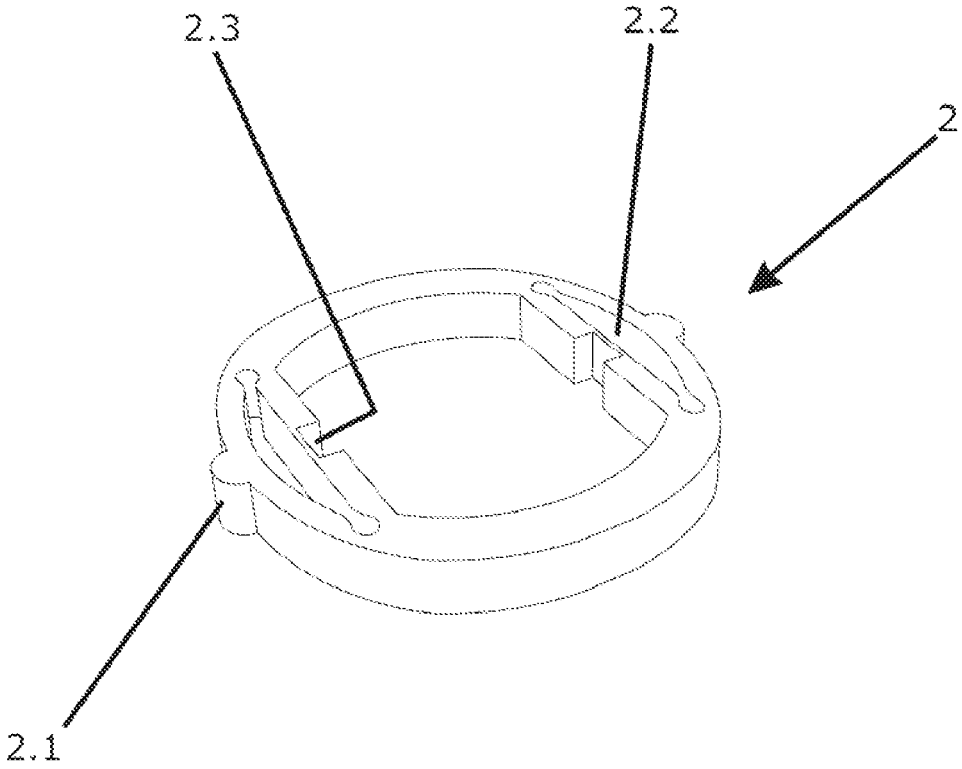
FIG. 2 is a perspective exploded view illustration of the positioning washer.
Figure 3:
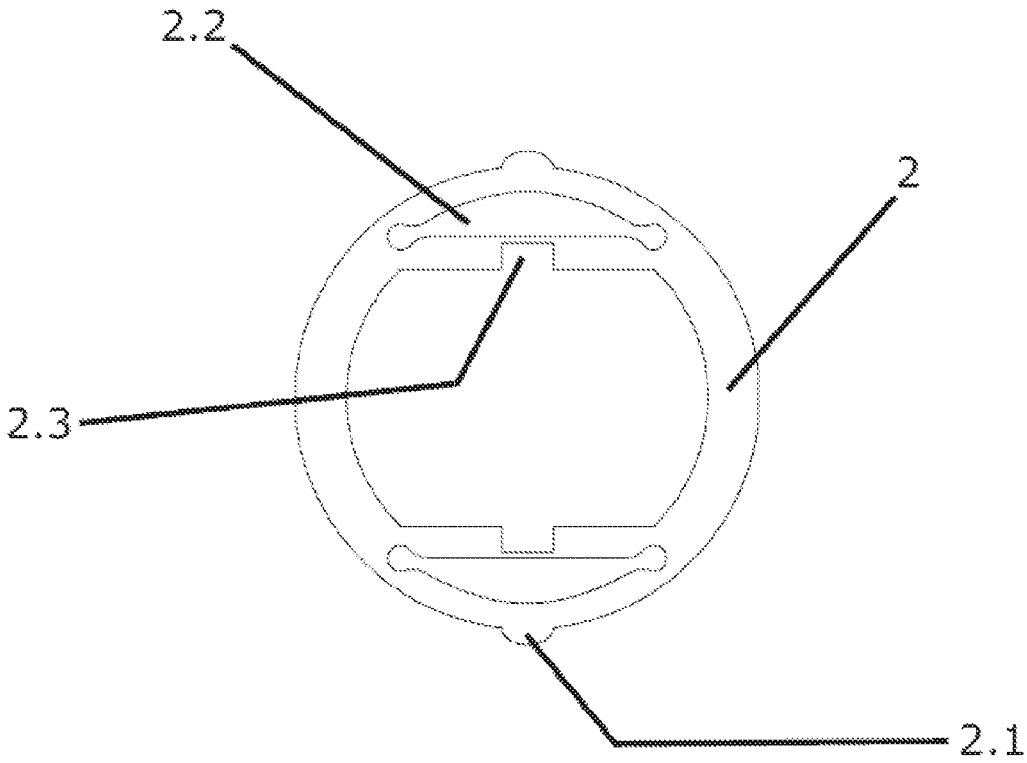
FIG. 3 is a planned view illustration of the positioning washer.
Figure 4:
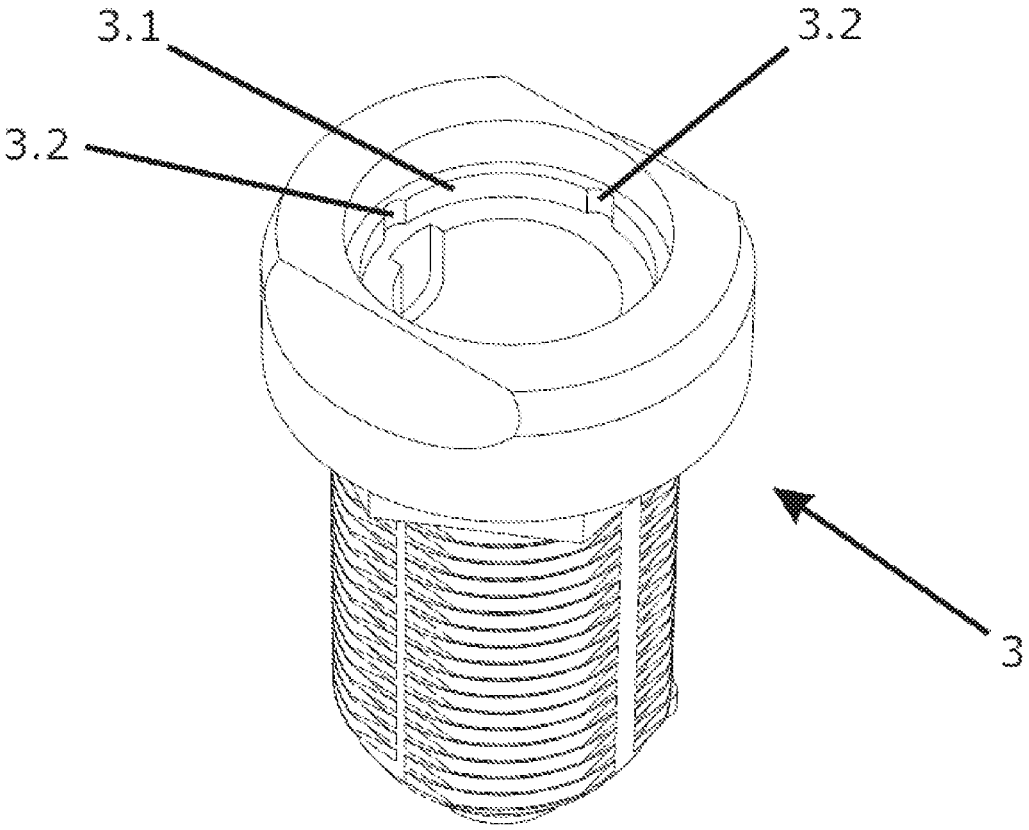
FIG. 4 is a perspective view illustration of the fixed bushing.
Figure 5:
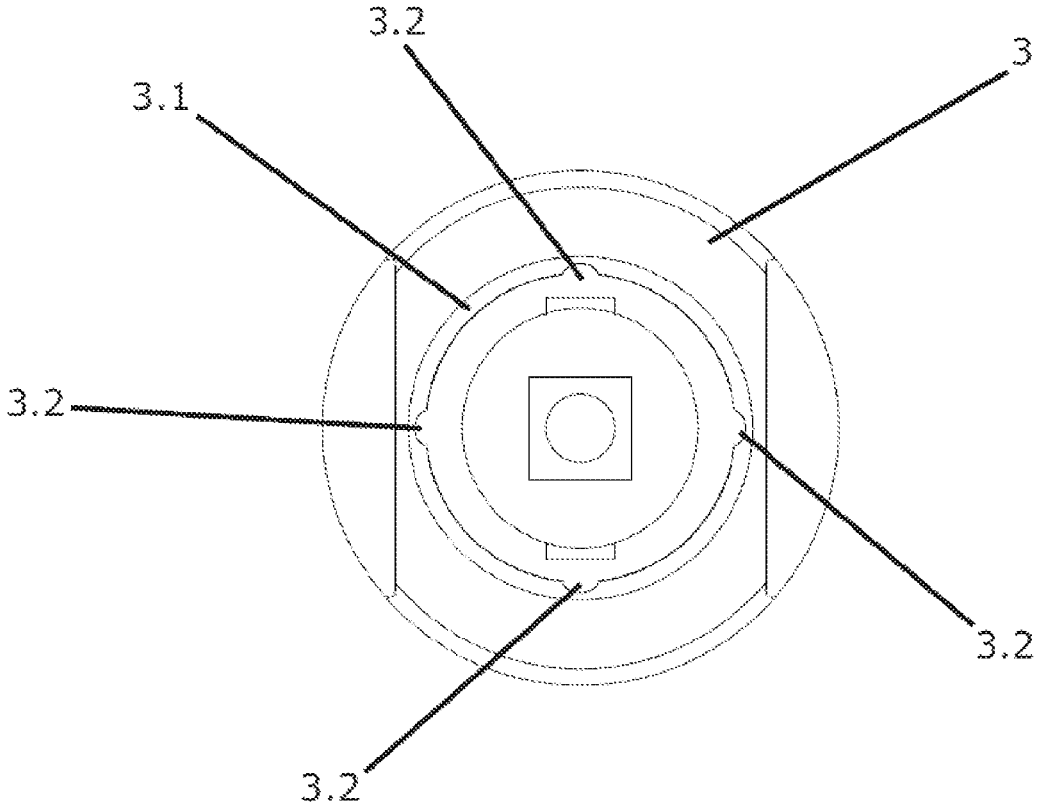
FIG. 5 is a planned view illustration of the fixed bushing.

Based on FIGS. 1, 2, 3, 4, and 5, it is noted that the door handle type closure system of the present invention basically comprises a door handle (1), a washer (2), a fixed bushing (3), and a movable latch (4).

The door handle (1) is basically a conventional door handle provided with a gripping handle and a coupling portion (1.1). The coupling portion (1.1) includes at least a longitudinal rib (1.2) that acts as a key.

The washer (2) is a "positioning washer" as described above, and is preferably made of a resilient thermoplastic material. The washer (2) comprises an annular ring body provided with two external upsets (2.1), two internal gaps (2.2), and, at least one cut (2.3) for coupling to the door handle.

The external upsets (2.1) have a semicircular perimeter and are disposed in a mirror image, that is, they are arranged on tangentially opposite points (180 degrees) on the washer (2).

The internal gaps (2.2) are arranged similarly to the external upsets (2.1), that is, they are disposed in a mirror image (or in tangentially opposite points). The perimeter of each internal gap (2.2) is preferably semicircular. Since the washer (2) is made of a resilient thermoplastic material, the internal gaps (2.2) are able to conform to the regions subject to temporary deformation, whereby the diameter of the washer ring (2) can be temporarily modified in a manner analogous to a spring, and so when reduced, the washer can function as a spring.

The two cuts (2.3) illustrated in the figures allow a functional coupling of the door handle (1) to the washer (2). This coupling occurs in a manner analogous to the key type coupling, where a longitudinal rib (1.2) of the door handle (1) is "placed" in one of the cuts (2.3) of the washer (2).

The fixed bushing (3) is also similar to a conventional fixed bushing used in conventional door handle type closure systems. However, the fixed bushing (3) described herein stands out from conventional fixed bushings because the conventional fixed bushings have a surrounding wall (3.1) in an interior whereof, while the surrounding wall of the fixed bushing (3) has at least four entrances (3.2) disposed in an equally-spaced manner. Specifically, it is noted that the entrances (3.2) have a semicircular perimeter similar to the perimeter of the external upsets (2.1) of the washer (2). Furthermore, the entrances (3.2) are disposed in a radial perpendicular manner, i.e., spaced in tangentially perpendicular points (90 degrees) to each other.

The movable latch (4), which is functionally linked to the door handle (2), is a traditional movable latch that is part of a conventional door handle type closure system.

The assembly of the elements composing the door handle type closure system described herein is simple. The fixed bushing (3) is fixed to a door (not shown). The washer (2) is inserted into the fixed bushing (3), so that the external upsets (2.1) are aligned to the two entrances (3.2). The door handle (1) is then attached to the closure system, so that its longitudinal ribs (1.2) are housed in the cuts (2.3) of the washer (2).

FIGS. 6, 7 and 8 illustrate schematically the operation of the closure system described herein.

The position shown in FIG. 6 is defined as the "open position" in an arbitrary manner. Thus, the position shown in FIG. 7 corresponds to an "intermediate position", and the position shown in FIG. 8 corresponds to a "closed position". It is important to note that the "open position" and the "intermediate position" have a Cartesian difference of ninety degrees to each other.

In the "open position" (see FIG. 6), it is noted that the washer (2), with its natural diameter, is housed in the fixed bushing (3) so that its external upsets (2.1) are arranged within two entrances (3.2) located opposite thereto in the fixed bushing (3). In this position, there is no clearance of any kind, since the washer (2) acts as a locking element, maintaining a stable positioning of the door handle (1).

When the door handle (1) is acted on by an external force (EF), it is noted that the external upsets (2.1) of the washer (2) are dislocated from the entrances (3.2) of the fixed bushing (3). However, the washer (2) remains placed inside the inner diameter of the enclosing wall (3.1) of the fixed bushing (3). Thus, it is noted that part of the washer (2) is deformed and this deformation reduces the original diameter of the washer (2), and loads the washer for the spring effect. This deformation, which is only possible due to the existence of internal gaps (2.2) of the washer (2), allows the washer (2) be circularly moved inside the surrounding wall (3.1). The washer (2) is kept deformed (i.e, kept at the smaller diameter) until the external upsets (2.1) are aligned with other entrances (3.2) of the fixed bushing (3), releasing the deformation and providing a positive feel with the engagement. The whole path of ninety degrees (between the entrances (3.2)) that the washer (2) travels through is defined as the "intermediate position" which is illustrated in FIG. 7.

In FIG. 8, which shows the "closed position", it is noted that, when returned to its natural diameter, the washer (2) is housed in the fixed bushing (3) so that its external upsets (2.1) are arranged within two entrances (3.2) located opposite thereto in the fixed bushing (3). In this position, there is no clearance of any kind, since the washer (2) acts as a locking element, maintaining a stable positioning of the door handle (1).

The invention claimed is:

1. A door handle type closure system consisting essentially of:

a door handle movable from a vertical position to a horizontal position, the door handle having a coupling portion provided with at least one longitudinal rib;

a movable latch attached to the coupling portion, which is movable by the handle for latching and unlatching a door;

a bushing fixed to the door; and, a positioning washer made of a resilient thermoplastic material and having an annular body provided with two external upsets, two internal gaps located adjacent the two external upsets, the positioning washer having at least one cutout portion;

each of said two resilient external upsets having a semicircular perimeter, the resilient external upsets being disposed at tangentially opposite positions on the washer;

said two internal gaps being disposed as a mirror image thereto, each internal gap having a matching semicircular perimeter, said two internal gaps being deformable, whereby a diameter of the resilient positioning washer is temporarily modified;

said at least one cutout portion providing a location for coupling with the at least one longitudinal rib of the door handle coupling portion such that the positioning washer moves therewith;

said fixed bushing having a surrounding wall in an interior thereof, said surrounding wall having at least four entrances disposed in an equally-spaced manner therearound, said resilient positioning washer being rotatable within said fixed bushing such that the external upsets are alignable with said entrances;

each said entrance having a semicircular perimeter sized to receive a perimeter of an external upset therein;

said entrances being disposed about the fixed bushing, spaced in tangentially perpendicular positions relative to each other with a first pair of entrances corresponding to the vertical position of the door handle and a second pair of entrances corresponding to the horizontal position of said door handle;

said entrances and said external upsets adapted to resiliently engage with sufficient force to limit movement of said door handle; and, wherein when said external upsets of the resilient positioning washer are resiliently received within said entrances, the door handle is held with sufficient force in said horizontal or vertical position to resist gravitational displacement of the door handle out of said horizontal or vertical position.

2. The door handle type closure system according to claim 1, wherein said positioning washer is rotatable within said fixed bushing, such that the two external upsets are rotated into engagement with the first pair of entrances disposed for positioning the door handle and attached latch with a vertical orientation, the door handle being locked by said positioning washer into either a latched or unlatched position, the positioning washer being rotatable within the fixed bushing so that the two external upsets are disengaged from the first pair of entrances, as the door handle is rotated from the vertical to the horizontal position, such that the door handle is in an intermediate position, with said internal gaps adjacent to the external upsets being deformed inwardly thereby, said positioning washer being further rotatable such that the two external upsets of the washer are rotated into resiliently engaging with the second pair of entrances of the fixed bushing when said door handle is in a horizontal and unlatched or latched position, said positioning washer having the two external upsets engaged with either pair of entrances for locking the door handle in the respective vertical or horizontal position.

* * * * *